United States Patent [19]

Black

[11] 4,186,169

[45] Jan. 29, 1980

[54] PROCESS AND APPARATUS FOR CONTINUOUSLY PRESTRESSING CONCRETE PRODUCTS

[75] Inventor: Alister Black, Blenheim, New Zealand

[73] Assignee: Universal Development Company Limited, Blenheim, New Zealand

[21] Appl. No.: 843,622

[22] Filed: Oct. 19, 1977

[30] Foreign Application Priority Data

Oct. 21, 1976 [NZ] New Zealand ..... 182391

[51] Int. Cl.[2] ..... B28B 21/60

[52] U.S. Cl. ..... 264/228; 254/29 A; 425/111

[58] Field of Search ..... 264/228, 297; 425/111; 254/29 A

[56] References Cited

U.S. PATENT DOCUMENTS

| | | | |
|---|---|---|---|
| 2,607,099 | 8/1952 | Schroder | 264/228 X |
| 2,745,164 | 5/1956 | Ros | 264/228 X |
| 3,903,222 | 9/1975 | Brown | 264/228 X |

*Primary Examiner*—Thomas P. Pavelko

*Attorney, Agent, or Firm*—Ladas, Parry, Von Gehr, Goldsmith & Deschamps

[57] ABSTRACT

A method and apparatus of prestressing reinforcing tendons in concrete products manufactured in separable moulds in a production line wherein the tendons are prestressed in a first product mould, a product is moulded in the first mould, a subsequent mould is then placed in series with the first mould, the reinforcing tendons are then prestressed between a point at the head of the production line and a previously moulded product.

3 Claims, 9 Drawing Figures

PROCESS AND APPARATUS FOR CONTINUOUSLY PRESTRESSING CONCRETE PRODUCTS

Figure 1:
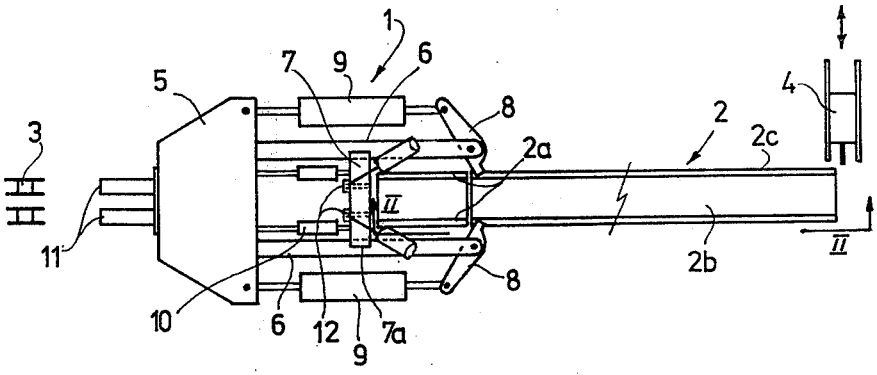

This invention relates to methods of, and apparatus for, prestressing reinforced concrete products.

Processes and apparatus for prestressing reinforces concrete products are known where bars or like high tensile reinforcing members are stretched prior to or during the moulding process so that when the concrete has hardened and stress transfer between the reinforcing bars and the concrete has taken place, the products are better able to resist tensile stresses under loaded or unloaded conditions.

Most known processes and apparatus for the manufacture of prestressed reinforced concrete products involve the provision of a tensioning means acting at opposing ends of a mould or product and such tensioning means are adapted to stretch the reinforcing bars before or during the moulding process. When the concrete has hardened to a desirable degree then the tensioning means is released and the product stripped from the mould.

When the products are stripped from the mould they have reinforcing bars extending from either end and if these are not required they are removed from the product by a suitable cutting process.

Prestressing operations as aforedescribed do not lend themselves easily to production line techniques.

Thus, it is an object of the present invention to provide a process for prestressing reinforced concrete products using a production line technique and an apparatus to enable such process to be carried out.

According to one aspect of this invention there is provided a method of prestressing reinforcing tendons in concrete products manufactured in separable moulds in a production line where the reinforcing tendons are continuous, comprising the steps of prestressing the tendons within a first product mould, moulding a product in the first mould, introducing a subsequent mould in series with the first mould, and prestressing the reinforcing tendons between at least one point at the head of the production line and the previously moulded product in which stress transfer between the reinforcing tendons and the product has taken place.

According to a further aspect of this invention there is provided apparatus for producing prestressed concrete products in separable moulds in a series in a production line comprising means for supplying continuous reinforcing tendons to the moulds, an elongate mould bed adapted to support a series of moulds at least part of which is adjacent a stationary tensioning frame for the apparatus, said tensioning frame being situated between the said means for supplying the reinforcing tendons to the moulds and the mould bed, means for advancing the moulds on the mould bed associated with the tensioning frame, primary anchoring means associated with the tensioning frame and adapted to grip and stress the reinforcing tendons, secondary anchoring means adapted to grip the reinforcing tendons fixed to said means for advancing the moulds on the mould bed and latch means associated with the tensioning frame adapted to hold the moulds in a predetermined position on the mould bed whilst a prestressing force is applied to the reinforcing tendons, whereby by transferring the grip on the reinforcing tendons from the primary to the secondary anchoring means or vice versa the prestressing force can be maintained in the reinforcing tendons whilst the said means for advancing the mould on the mould bed operates to make way for a fresh mould on the mould bed.

Figure 2:
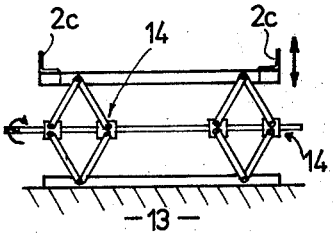
Figure 2:
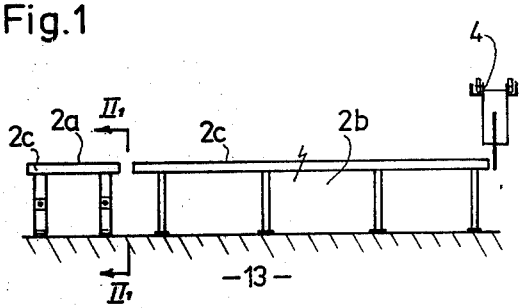
Figure 3:
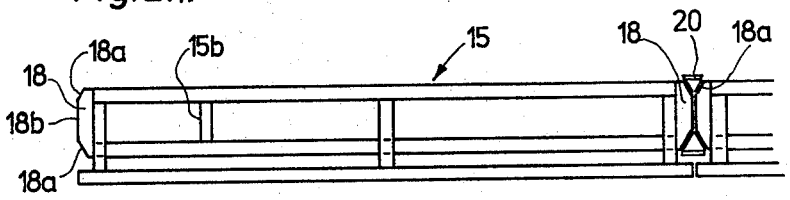
Figure 3A:
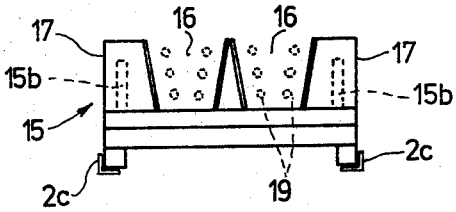
Figure 4:
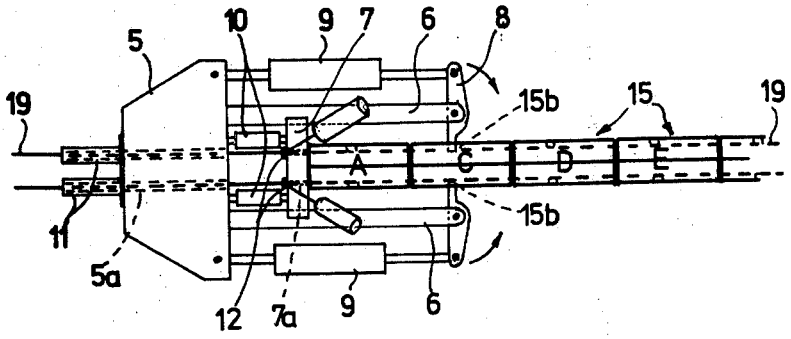
Figure 4:
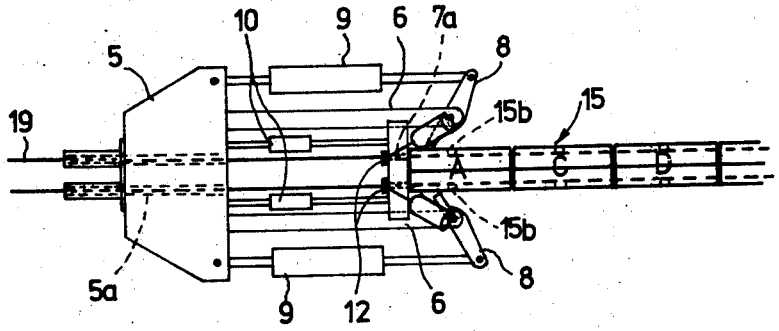
Figure 5:
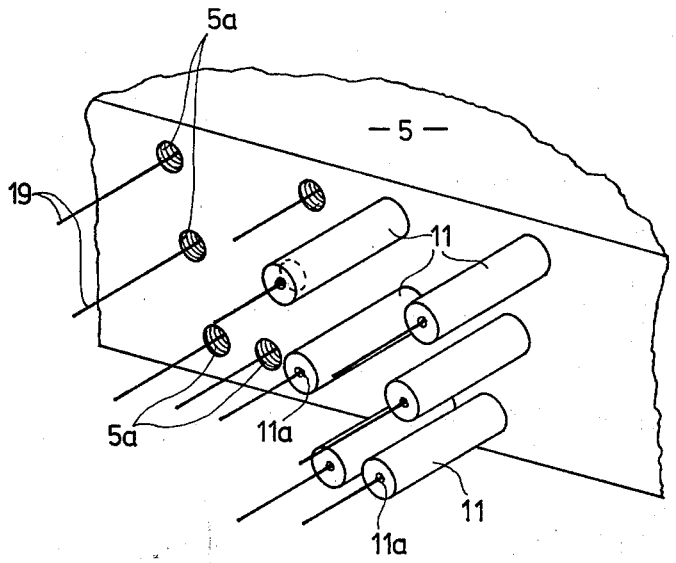
Figure 6:
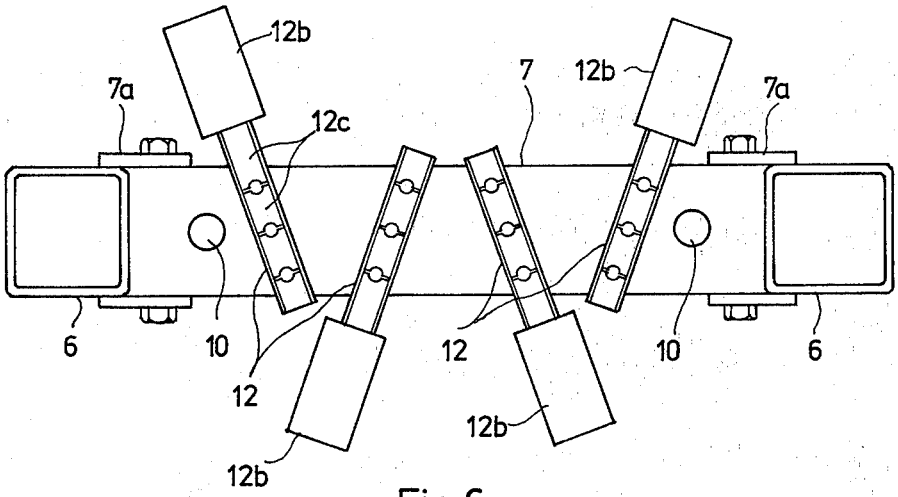

An example of the apparatus of the present invention and the mode of operation will be described with reference to the accompanying drawings in which:

FIG. 1 is a diagrammatic plan view of the apparatus of the present invention, and FIG. 2 is a side view taken at II—II of FIG. 1, and FIG. 2(i) is a side view taken at II(i)—II(i) of FIG. 2, and FIG. 3 is a side view of a typical mould for the present invention, and FIG. 3(i) is a diagrammatic cross-section of the mould of FIG. 3, and FIG. 4 is a diagrammatic plan view illustrating apparatus of the present invention with moulds loaded thereon, and FIG. 4(i) is a further diagrammatic plan view of the apparatus of the present invention and shows the position of the crosshead device in an advanced position, and FIG. 5 is a diagrammatic perspective view of the head frame of the tensioning frame of the present invention and shows the primary anchoring means of the present invention in position on reinforcing tendons for a product, and FIG. 6 is a diagrammatic cross-section of the crosshead device of the present invention and the ram operated secondary anchoring means.

Referring firstly to FIG. 1 of the drawings the apparatus of the present invention includes a tensioning frame indicated by arrow 1, a mould bed indicated by arrow 2, means 3 for providing a supply of continuous reinforcing tendons to moulds in the process and a cutter 4.

The tensioning frame 1 which can be supported from a ground surface by suitable means (not shown) comprises a head frame 5, and two parallel support members 6 which extend outwardly therefrom. A substantially elongate crosshead 7 is positioned substantially parallel to the head frame 5 and has its ends *7a* supported by the support members 6 in such a manner as to allow the crosshead 7 to be advanced and retracted relative to the head frame 5. The ends of the support members 6 each pivotally support latches 8, whose pivotable movement is controlled by suitable means, for example, a ram 9 which has one end pivotably attached to the latches 8 and the other end pivotably attached to the head frame 5.

The crosshead 7 can be advanced and retracted by suitable means such as a winch (not shown) or by a pair of double acting rams 10. The rams 10 are spaced equally from the longitudinal central axis of the tensioning frame so as to ensure an exact parallel relationship between the head frame 5 and the crosshead 7 when the crosshead is advanced and retracted.

The head frame 5 and the crosshead 7 are provided with a plurality of aligned apertures, 5*a* and *7a* respectively, through which reinforcing tendons (not shown in FIG. 1) for a product to be moulded can freely pass. At an entry point to each of said plurality of apertures, anchoring means are provided. In the case of the head frame 5 a gripping and stress applying ram 11 (hereinafter referred to as the primary anchoring means) capable of gripping and stretching reinforcing tendons is provided for each aperture 5*a* and for each reinforcing tendons to be stressed and in the case of the crosshead 7 a ram operated gripping means 12 (hereinafter referred to as the secondary anchoring means) is provided. Each of the ram operated secondary anchoring means is capable of gripping a plurality of reinforcing tendons.

The mould bed 2 has two parts, a first part 2*a* which underlies the tensioning frame 1 and which is adapted to be lowered to accept new moulds, and a second elongate part 2*b* which is adapted to carry moulded products to a cutting station positioned at the distal end thereof where cutter 4 is positioned.

The mould bed 2 and the relative position of the cutter 4 is illustrated by FIGS. 2 and 2(i) of the drawings. The first part 2*a* of the mould bed 2 is adapted to be lowered to accept new moulds and raised again to position the new moulds in series in a train with moulds already on the mould bed part 2*b* (this procedure is described later).

The mould bed 2 is provided with spaced parallel rails 2*c* which are adapted to support the moulds (not shown in either of FIGS. 1 and 2).

The first part 2*a* of the mould bed as aforesaid can be lowered and the preferred arrangement for achieving this is shown in FIG. 2(i). The arrangement consists of a top frame which carries parallel rails 2*c*, the rails being spaced identically to that rails of part 2*b*, and a lower frame which is fastened to a ground surface 12. Two pairs of spaced screw jacks indicated by arrow 14 are fixed by links to the top and bottom frames, and the screw jacks 14 are operable to raise or lower the mould bed 2*a*.

FIG. 3 illustrates a typical mould indicated by arrow 15 for use with the apparatus of the present invention. The particular mould illustrated is provided for moulding a pair of railway sleepers side by side however, the process and apparatus of the present invention is equally applicable to moulding other prestressed concrete products and should not be taken to be restricted to the manufacture of railway sleepers. Further, the mould shown produces two railway sleepers side by side and the apparatus aforedescribed is designed for use with such a mould, that is, for producing two railway sleepers in each mould and two sets of reinforcing tendons (one for each product) are catered for. It will be appreciated that the apparatus could be arranged to cater for moulding side by side a number of products within each mould merely by extending the width of the tensioning frame 1 and increasing the number of anchoring means 11 and 12.

The mould of FIG. 3 comprises an upper portion having two parallel troughed formers 16 in which products can be moulded sides 17 and formed ends 18. When the moulds are placed on the mould bed 2 the lower portions thereof rest on the side rails 2*c* of the mould bed (see FIG. 3(i)). The formed ends 18 of the moulds have two converging chamfered surfaces 18*a* joined by an upright part 18*b*. A typical railway sleeper is reinforced by six 10 mm diameter reinforcing tendons and in FIG. 3 the tendons 19 are shown in dotted outline. During the production process of the present invention the reinforcing tendons 19 are continuous, and pass from mould to mould, and when the moulds are placed in series on the mould bed 2, top and bottom crossbars 20 having chamfered portions complementary with the converging portions 18*a* of the ends of the moulds 15 are clamped in position at the join between two adjacent ends of the moulds (see FIG. 3). The reinforcing tendons 19 pass from mould to mould inside the bottom and top extremities respectively of the top and bottom crossbars 20. Once the production process of the present invention is under way and a prestressing force is applied to the reinforcing tendons 19, there can be no movement of set concrete in the moulds because top and bottom portions of the ends of each product bear against the chamfered surfaces of the crossbars 20. Thus stress in the reinforcing bars is resisted by the moulded product rather than the moulds themselves.

Each mould 15 is provided with a recessed or extending portion 14*b* which can be engaged by the latches 8 of the apparatus when the moulds are placed on the mould bed 2.

FIG. 4 of the drawings is a diagrammatic drawing of the apparatus of the present invention with the moulds 15 loaded thereon at a time when a production run is under way, and FIG. 4(i) of the drawings shows diagrammatically the apparatus with the crosshead 7 advanced one mould length prior to a fresh mould being positioned on the mould bed part 2*a*. Referring to FIG. 4 and 4(i) of the drawings, the moulds 15 are placed end to end on the mould bed, a first mould A being accommodated on the part 2*a* of the mould bed and the remaining moulds, C, D, E, etc., being placed on the extending part 2*b* of the mould bed 2. Each mould is an identical and predetermined length.

Reinforcing tendons 19 (a single tendon only for each mould is shown) are fed from the supply source 3 via the primary anchoring means 11, through apertures 5*a* in the crosshead 4, through the secondary anchoring means 12 and then into the moulds 15. In the situation illustrated it is assumed that a stress transfer between the reinforcing bars 19 of the products at the distal end of the production line and the poured concrete in the moulds has taken place. Thus the reinforcing bars are "anchored" in the concrete.

Once the process is under way (in this situation a prestress force exists in the tendons 19 and the primary and secondary anchoring means 11 and 12 respectively are gripping the reinforcing tendons) and it is desired to place a fresh mould 15 on the mould bed, the following procedure described with reference to FIGS. 4 and 4(i) is carried out:

(a) The primary anchoring means 10 are released (the secondary anchoring means 12 at this point still grip the reinforcing tendons 19).

(b) The latches 8 which engage with the parts 15*b* of the mould C are released.

(c) The rams 10 are activated and the crosshead 7, and thus the moulds 15 are advanced one mould length to the position shown in FIG. 4(i). All moulds A,C,D, and E have advanced by a distance equivalent to one mould length.

(d) The latches 8 are reapplied, this time engaging the parts 15*b* of the second mould in the production line (mould A).

(e) The primary anchoring means 11 are reapplied and the tendons 19 are stressed to allow for the additional (one mould length) length of reinforcing tendons introduced into the production line from the supply source.

(f) The secondary anchoring means 12 is released and the crosshead retracted.

(g) A fresh mould is loaded on to the mould bed part 2*a*.

(i) The secondary anchoring means are reapplied.

The aforegoing description describes for convenience the process for introducing a new mould to the production line when there are previously moulded products on the production line and the reinforcing tendons are able to be stressed between the anchoring means and the previously moulded products. The present invention is primarily concerned with this situation. Before this situation is reached however, the process needs to be started and to do this two moulds, for example moulds A and C of FIG. 4 are placed on the mould bed 2. To commence the process the reinforcing 19 are threaded through the apparatus and the free ends thereof are secured by "dummy" anchoring means (not shown) which hold the tendons 19. The strands can then be stressed and the primary and secondary anchoring means 11 and 12 activated to grip the reinforcing tendons. Concrete can be poured into the mould C and allowed to set and the "dummy" anchoring means removed from the ends of the mould C.

FIGS. 5 and 6 of the drawings illustrate diagrammatically the relative positions of the primary and secondary anchoring means respectively.

The particular arrangements and constructions of the anchoring means 11 and 12 are not essential to the present invention and those used are adaptions of known apparatus.

As aforesaid the primary anchoring means 11 serve two functions, firstly to grip each individual reinforcing tendons 19, and secondly to stretch (prestress) the tendons. Both functions are carried out by a unitary member. The primary anchoring means are fixed to the head frame 5 and the tendons 19 pass through a central aperture 11*a* thereof. During the prestressing operation the rams extend rearwardly relative to the head frame 5.

The second anchoring means 12 are operated by rams 12*b* and each anchoring means is adapted to grip a plurality of reinforcing tendons 19. The rams 12*b* are activated to close normally open jaws 12*c* on each reinforcing tendons 19.

The production line for the present invention can by any length and as the empty moulds 15 pass from the vicinity of the tensioning frame 1, the products can be moulded and eventually at the end of the production line, sawn by the cutter 4. The moulding process may include the introduction of concrete into the moulds with simultaneous vibration of the moulds, or the freshly moulded products can be vibrated separately.

At the end of the production line the products are cut by the transversely reciprocating saw 4. Prior to the cutting operation the top and bottom, cross bars 20 are removed and a cut is made between the moulds 15 which separate the moulds and products inside the moulds. In this respect, when the cross bars 20 are clamped at a join between two moulds, the ends of the moulds (see FIG. 3) are slightly spaced apart. This spacing is sufficient to allow a saw cut to be made. When the cutter 4 is advanced it cuts through the concrete and the reinforcing tendons extending between the moulds. Once each mould 15 has been separated, the products can be removed from the mould and the empty moulds cleaned and returned to the other end of the production line for reloading on to the mould bed part 2*a* at the head of the production line.

I claim:

1. A method of prestressing reinforcing tendons in concrete products manufactured in separable moulds in a production line where the reinforcing tendons are continuous, comprising the steps of prestressing the tendons within a first product mould, moulding a product in the first product mould, introducing a subsequent mould in series with the first mould, and prestressing the reinforcing tendons between at least one point at the head of the production line and the previously moulded product in which stress transfer between the reinforcing and the product has taken place, wherein said at least one point at the head of the production line is transfered from a static primary anchoring means on the production line to a secondary anchoring means fixed to a longitudinally movable device which advances the moulds in the production line wherein said subsequent mould is introduced between the previously molded product and the secondary anchoring means.

2. A method of prestressing reinforcing tendons in concrete products manufactured in separable moulds in a production line where the reinforcing tendons are continuous, comprising prestressing the reinforcing tendons between at least one point at the head of the production line and a previously moulded product in which stress transfer between the reinforcing tendons and the product has taken place, transferring said at least one point at the head of the production line from a static primary anchoring means on the production line to a secondary anchoring means fixed to a longitudinally movable device, advancing said longitudinally movable device whilst maintaining the prestress force in the tendons between the secondary anchoring device and said previously moulded product, reapplying said primary anchoring means and prestressing the new length of reinforcing tendon between the primary and secondary anchoring means having regard to the additional new length of reinforcing tendon introduced, releasing the secondary anchoring means, retracting said longitudinally movable device and introducing a new mould to the production line between the last mould and said secondary anchoring means, and reapplying said secondary anchoring means.

3. A method of introducing a new mould to an apparatus for producing prestressed concrete products in separable moulds in series on a mould bed of a production line at a time when the prestressing force exists in reinforcing tendons, the tendons being anchored at one end of the production line in a previously moulded product and at the other end of the production line by a tensioning frame at the head of the production line, said method comprising the steps of:

(a) releasing primary anchoring means associated with the tensioning frame, (b) releasing latches which are associated with the tensioning frame and adapted to hold moulds in a predetermined position on the mould bed while the tendons are in a stressed state, (c) advancing a crosshead device of the apparatus relative to a head frame of the tensioning frame which results in advancement of the moulds on the production by one mould length, (d) reapplying the latches, (e) reapplying said primary anchoring means and stressing the reinforcing tendons between primary and secondary anchoring means having regard to the movement forward of the crosshead device, (f) releasing secondary anchoring means which are adapted to grip the reinforcing tendons and which are fixed to the crosshead device, (g) retracting the crosshead device, (h) loading a fresh mould onto the mould bed between the previously moulded product and secondary anchoring means, and (i) reapplying the secondary anchoring means.

* * * * *